US007374064B2

(12) United States Patent
Robinson

(10) Patent No.: US 7,374,064 B2
(45) Date of Patent: May 20, 2008

(54) WASTE RECEPTACLE

(76) Inventor: C. Bivins Robinson, 1101 W. Alden Ave., Valdosta, GA (US) 31602

( * ) Notice: Subject to any disclaimer, the term of this patent is extended or adjusted under 35 U.S.C. 154(b) by 514 days.

(21) Appl. No.: 10/824,462

(22) Filed: Apr. 14, 2004

(65) Prior Publication Data

US 2005/0230400 A1 Oct. 20, 2005

(51) Int. Cl.
*B65D 90/12* (2006.01)
*B65D 1/40* (2006.01)

(52) U.S. Cl. ..... 220/629; 220/729; 220/908

(58) Field of Classification Search ..... 220/629, 220/729, 762, 764, 908
See application file for complete search history.

(56) References Cited

U.S. PATENT DOCUMENTS

| | | | | |
|---|---|---|---|---|
| 3,927,786 | A | 12/1975 | Aboud | |
| 4,666,054 | A | 5/1987 | Jaicks | |
| 4,890,760 | A | 1/1990 | Nicoll et al. | |
| 5,163,579 | A | 11/1992 | Jones | |
| 5,269,434 | A | 12/1993 | LaBuda | |
| 5,390,812 | A | 2/1995 | Spiro | |
| 5,390,818 | A | 2/1995 | LaBuda | |
| 5,690,247 | A | 11/1997 | Boover | |
| 5,803,303 | A | 9/1998 | Timm et al. | |
| D418,958 | S | 1/2000 | Wood et al. | |
| 6,102,343 | A | 8/2000 | Grimesey et al. | |
| 6,471,221 | B1 | 10/2002 | McGarry | |
| D467,697 | S | 12/2002 | Spadafora | |
| 2003/0076017 | A1* | 4/2003 | Helot et al. | 312/223.2 |

* cited by examiner

*Primary Examiner*—Anthony D. Stashick
*Assistant Examiner*—Harry A Grosso
(74) *Attorney, Agent, or Firm*—Langdale Vallotton, LLP; John P. Sinnott

(57) ABSTRACT

A stable waste receptacle has in the preferred embodiment, at least two foot pedals mounted on opposite sides of the receptacle, at the receptacle's base. Recessed housings are formed in the base and sides to permit the foot pedals to be withdrawn from the housings to stabilize the receptacle during trash bag removal or to be pressed back into the respective housings for telescopically stacking multiple receptacles. Detents are provided to retain the foot pedals releasably in the extended and retracted positions.

2 Claims, 2 Drawing Sheets

WASTE RECEPTACLE

CROSS-REFERENCE TO RELATED APPLICATIONS

None

FEDERALLY SPONSORED RESEARCH OR DEVELOPMENT

None

SEQUENCE LISTING

None

BACKGROUND OF THE INVENTION

This invention relates to improved waste receptacles and, more particularly, to receptacles with foot pedals for selective extension from the receptacle base to aid in flexible trash bag removal, and the like.

Waste receptacles that support flexible trash bags are popular and useful items for home and for commercial use. Ordinarily, a waste receptacle holds a flexible trash bag in an upright position with the unsealed end of the bag uppermost and open within the receptacle. Waste, trash and the like are deposited in the open bag. When it becomes necessary or desirable to remove the flexible bag for disposal, it is customary to grasp the waste receptacle with one hand and gather together with the other hand the open end of the flexible bag. The flexible bag, so held, is then withdrawn from the waste receptacle for disposal with its contents.

The foregoing is the ideal situation that all too frequently does not occur. Thus, when the flexible bag is too full, drawing the open end together with one hand often leads to immersing at least a part of the hand in the collected waste and spilling some of the waste from the flexible bag on the waste receptacle and surrounding surfaces. Given, moreover, the basic instability of the usual waste receptacle, held with one hand and, at the same time, grappling with the open end of the flexible bag with the other hand while bending over the receptacle at an awkward body angle frequently results in tipping the entire assembly waste and all-onto the floor.

To overcome these problems foot pads molded into the base of the receptacle have been proposed. These foot pads protrude out from the waste receptacle base in the expectation that by stepping on the pads, the waste receptacle is stabilized, freeing both hands to be used to gather the open top of the flexible bag and withdraw the bag from the receptacle.

This proposal, however, fails to satisfy practical commercial requirements. Illustratively, the fixed, protruding foot pads prevent these trash receptacles from being loaded or telescoped into stacks for efficient shipping, storage and shelving. Each one of these waste receptacles must be shipped, warehoused and displayed individually, which is a most unsatisfactory commercial situation.

Another proposal suggests mounting a spring biased pedal in a recess formed in a side of the waste receptacle and near the receptacle's base. A foot can press the pedal down against the supporting floor to enable both hands to withdraw the flexible bag from the waste receptacle. This proposal, apart from difficulty and expense in manufacture also exhibits an unsatisfactory characteristic. Thus, as the flexible bag is withdrawn from the waste receptacle, the essentially unrestrained waste receptacle, responding to the force of the biasing spring, may tip over toward the pedal, to result in spilled waste.

Consequently, there is a need for an inexpensive and stable waste receptacle that can free the user to apply both hands to withdraw the flexible bag from the receptacle when removing trash. The waste receptacle also must satisfy commercial needs with respect to economical shipping, warehousing and display.

SUMMARY OF THE INVENTION

These and other difficulties that have characterized the prior art are overcome, to a large extent, through the practice of the invention.

A waste receptacle in accordance with features of the invention, for example, is provided with a pair of selectively extendable foot pedals that are mounted in housings on opposite sides of the receptacle base. These foot pedals are, for purposes of shipping and shelving, retracted within the receptacle to enable several receptacles to be telescoped or mounted within adjoining receptacles for efficient shipment and storage.

These foot pedals, moreover, can be manually extended from their respective housings in order to provide individual surfaces on which a user can place a respective foot to press the receptacle against the floor. In this way, the receptacle is stabilized while freeing the user's both hands to withdraw the flexible trash bag from the receptacle confines.

After use, the foot pedals can be pressed back into their respective housings, or by means of detents, retained in the extended portion.

Three illustrative techniques for mounting the foot pedals on the waste receptacle base are shown and described. One technique provides a pair of horizontally disposed pedals each received in a respective recessed housing formed in opposite sides of the receptacle base. The foot pedals are manually drawn out from their housings, to extend parallel with the receptacle's base. As noted above, the pedals can be pressed back into their respective housings or left in the extended portion.

Another technique that characterizes the invention mounts the pedals in respective housings formed in opposite sides of the receptacle base. These pedals, however, are selectively extended by pivoting them downward from the base and outwardly until the pedals are approximately in alignment with the base. This novel structure enables the pedals to be left in a fully extended condition or retracted after use, as desired.

As a further alternative, recesses formed in opposite sides of the receptacle adjoining the receptacle base house individual foot pedals. These pedals are selectively held in the respective housings through detents. Pivoting these pedals downwardly and outwardly to the level of the receptacle base enables the pedals to bear against the supporting surface for the receptacle. Detents on the pedals, when extended in the foregoing manner, retain the pedals in an extended position that allow the user to place a foot on each one of the two pedals and withdraw the flexible trash bag from the receptacle with both hands. The foot pedals, moreover, with detents engaged, can be left in the extended positions or, if desired, pressed to pivot upwardly and back into the respective recesses in the side walls of the receptacle.

It also should be noted that the principles of the invention are applicable to waste receptacles with shapes other than rectangular as, for example, cylindrical and truncated conical waste receptacles.

As a result, the problems created by trying to withdraw flexible trash bags from a waste receptacle with one hand while attempting to stabilize the receptacle with the other hand are largely overcome through the practice of the invention.

These and other features of the invention are described more completely in the following detailed description of preferred embodiments of the invention when taken with the figures of the drawing. The scope of the invention, however, is limited only through the claims appended hereto.

DETAILED DESCRIPTION OF THE PREFERRED EMBODIMENTS

Figure 1:
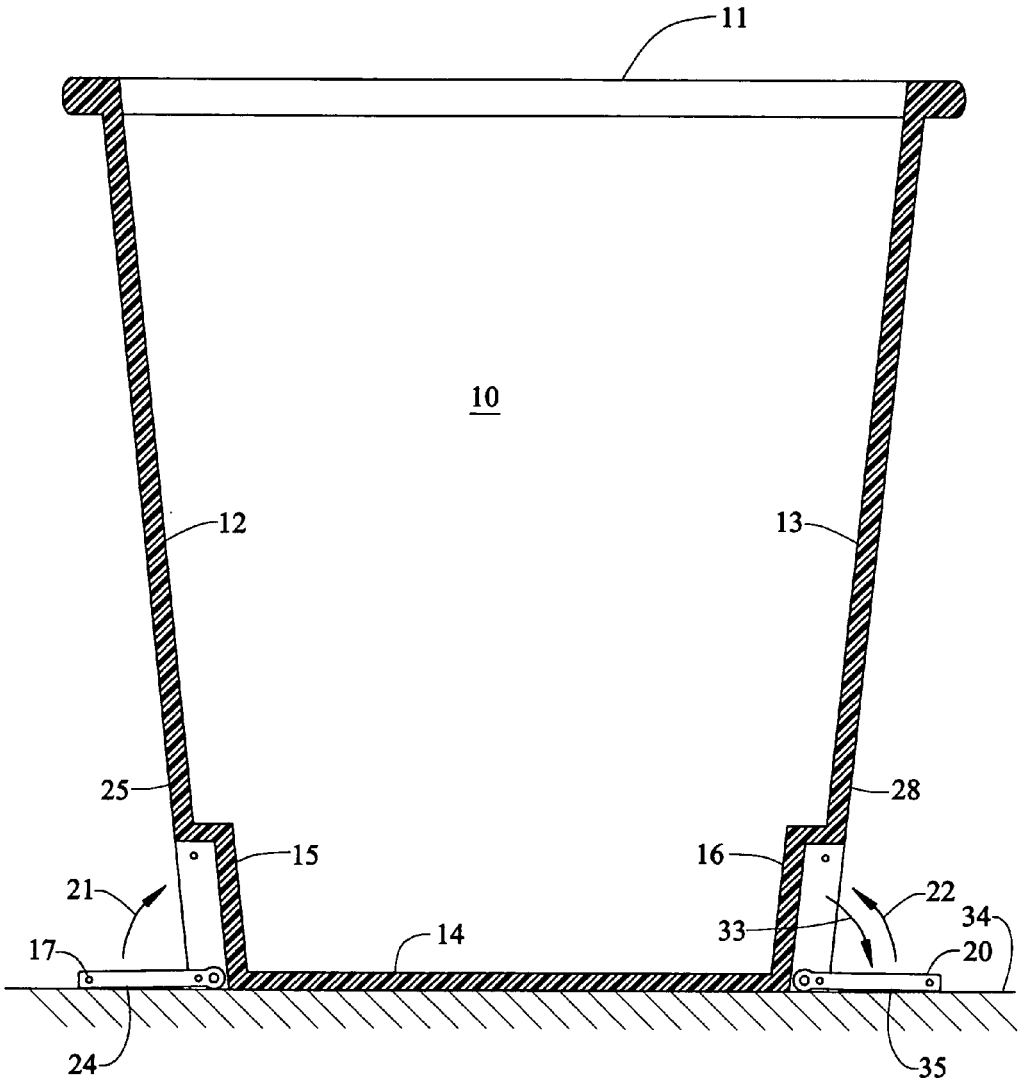
FIG. 1 is a front elevation in full section of a waste receptacle that embodies features of the invention.

As best illustrated in FIG. 1, a generally rectangular waste receptacle 10 is provided with an open top 11 for receiving a flexible, removable trash bag (not shown in the drawing). A pair of opposing lateral sides 12, 13 extend from the open top 11 to a generally flat base 14. Recessed housings 15, 16 are formed in opposite respective sides 12, 13 of the receptacle 10. The housings 15, 16, moreover, are formed in the receptacle 10 adjoining the base 14.

Figure 2:
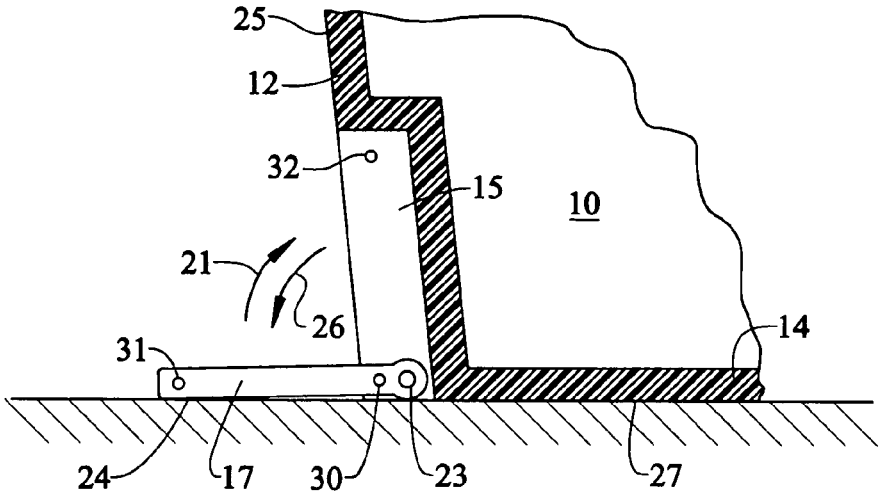
FIG. 2 is a partial view, in section, of a foot pedal for use in connection with the structure shown in FIG. 1.

In accordance with a feature of the invention foot pedals 17, 20 each are selectively foldable in the direction of respective arrows 21, 22 into the individual housings 15, 16. A specific structure that characterizes features of this invention is shown in FIG. 2. As illustrated, the foot pedal 17 has a shaft 23 that is received in corresponding journals (not shown in the drawing) that are formed in the recessed housing 15. In this manner, the foot pedal 17 can be pivoted back into the recessed housing 15 in the direction of the arrow 21. When so received within the housing 15, exposed surface 24 of the pedal 17 is generally flush with outer surface 25 of the lateral side 12 of the receptacle 10.

When withdrawn from the housing 15 in the direction of arrow 26, at full extension, the exposed surface surface 24 of the foot pedal 17 lies essentially flush with external surface 27 of the base 14. To maintain the foot pedal 17 in the extended condition illustrated in FIG. 2, two detents are used, of which only boss 30 is shown protruding from the lateral side of the foot pedal 17. The boss 30 selectively engages in a mating recess (not shown in the drawing) formed in the base 14. The boss 30, moreover, snaps into, or out of the mating recess through the natural resiliency of materials from which the foot pedal 17 and the receptacle 10 are formed.

The force required to snap the boss 30 out of it mating recess is sufficient to enable the foot pedal 17 to remain in the extended condition through the stresses of ordinary use.

In a similar manner, by pivoting the foot pedal 17 into the housing 15 in the direction of the arrow 21, boss 30 and the companion boss on the opposite side of the pedal 17 disengage from their respective recesses (not shown in the drawing). With the detents at the base 14 of the receptacle 10 disengaged, and the foot pedal 17 being pivoted into the recessed housing 15, a detent or boss 31 on the free end of the foot pedal 17 snaps into a mating recess (not shown in the drawing) to retain the foot pedal 17 in the upwardly folded position. A corresponding boss (not shown in the drawing) protrudes from the side of the foot pedal 17 opposite to the boss 31 in order to engage and be received in a mating recess 32. A similar system of detents, bosses and mating recesses is provided for the foot pedal 20 (FIG. 1). In this manner, the exposed surface 24 of the foot pedal 17 and exposed surface 35 of the corresponding pedal 20 are held in positions that are flush with the respective outer surface 25 and outer surface 28 of the receptacle 10.

In operation, and as shown FIG. 1, the foot pedal 20, at the base 14 and the lateral side 13 is pivoted from the housing 16 in the direction of arrow 33 to extend from the base 14. In this manner, with the appropriate detents engaged, the two foot pedals 17, 20 are extended as shown in FIG. 1. The waste receptacle is stabilized against supporting surface 34 by placing each foot of the user on a respective one of the two foot pedals 17, 20. Thus, stabilized, the user is free to apply both hands to withdrawing a flexible trash bag (not shown in the drawing) from the open top 11 of the waste receptacle 10.

To retract the foot pedals 17, 20 in order to telescopically stack several of the waste receptacles, or for purposes of display or storage, it is only necessary to overcome the detent forces and pivot the foot pedals 17, 20 in the direction of the respective arrows 21, 22. The exposed surface 24 on the foot pedal 17 and the exposed surface 35 on the foot pedal 20 now lie flush with the respective outer surfaces 25 and 28 of the waste receptacle 10. Accordingly, the foot pedals 17, 20, so retracted, do not block or interfere with stacking or other handling that is required of the waste receptacle 10.

Figure 3:
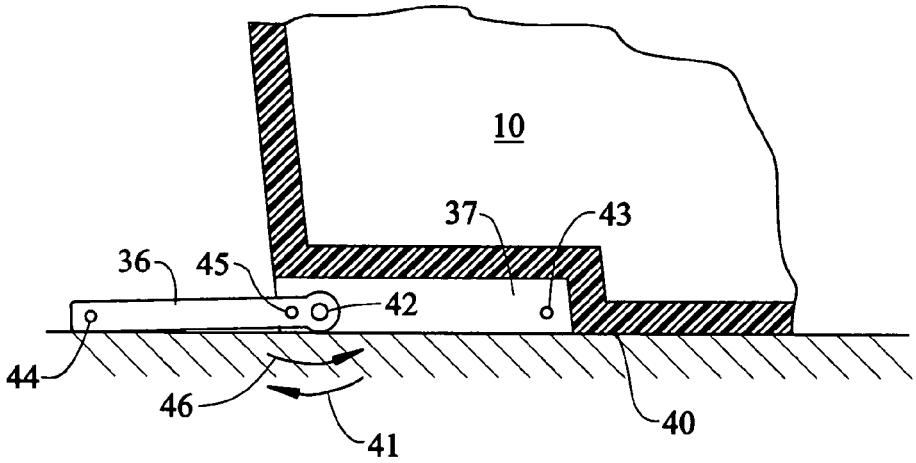
FIG. 3 is a partial view, in section, of another embodiment of a foot pedal for use in connection with the structure shown in FIG. 1.

An alternative mounting for waste receptacle foot pedals embodying principles of the invention is illustrated in FIG. 3 For example, a foot pedal 36 is mounted in a recessed housing 37 formed in base 40. To extend the foot pedal 36 from the housing 37 in the direction of arrow 41, the foot pedal 36 is pivoted about a shaft 42 that is journalled in the base 40. To pivot the pedal 36 in the direction of the arrow 41, the pedal 36 is pressed downwardly to overcome retention by detents, of which only mating detent recess 43 and a boss 44 that protrudes from the distal end on the opposite side of the foot pedal 36 is shown in the Figure.

When fully extended, a pair of detents, of which only detent boss 45 is shown in the drawing, engage corresponding mating recesses in the lateral sides of the housing 37 to selectively lock the foot pedal 36 into its extended position. On retraction, it is only necessary to overcome the locking effect of the detents (of which the detent boss 45 is illustrative) and press the extended foot pedal 36 back toward the housing 37 in the direction of arrow 46. On retraction, the detents of which the boss 44 and the detent recess 43 are typical, engage the foot pedal 36 and retain the pedal 36 in the housing 37. In accordance with a feature of the invention, the foot pedal 36 has a companion foot pedal (not shown in the drawing) of essentially the same construction mounted on the side of the waste receptacle 10 that is opposite to the position of the foot pedal 36. In this fashion, two foot pedals are made available to stabilize the waste receptacle 10 and to enable use of both hands to withdraw a flexible trash bag (not shown in the drawing) from the receptacle 10.

Figure 4:
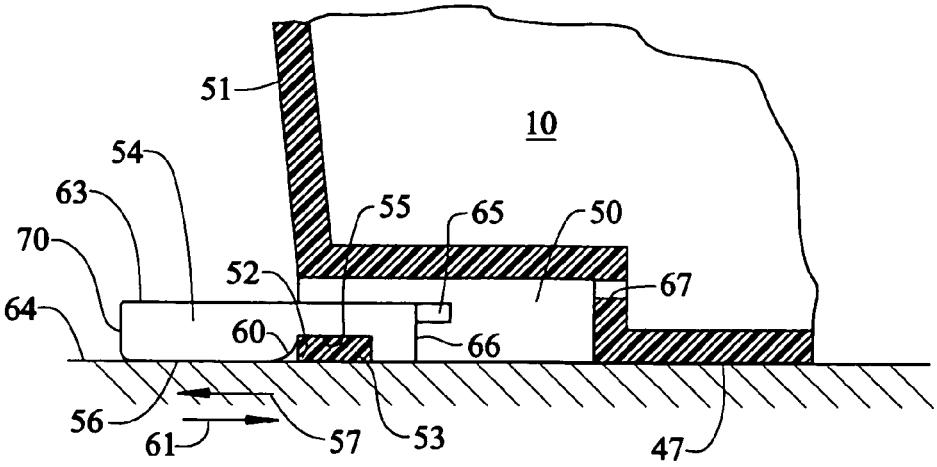
FIG. 4 is a partial view in section of still another embodiment of a foot pedal for use in connection with the structure showing FIG. 1.

A further embodiment of the invention is shown in FIG. 4. Base 47 of the receptacle 10 has a recessed housing 50 formed at the junction between the base 47 and side 51. At a corner 52 formed by the intersection of the base 47 and the side 51 a stop 53 is provided that is joined to both sides of the housing 50.

A foot pedal 54 bridges over the stop 53. In order to bridge over the stop 53 and thus to retain the foot pedal 54 in the fully extended status shown in FIG. 4, an indentation 55 is formed in bearing surface 56 of the pedal 54 that receives the stop 53.

In further operation, the foot pedal 54 is manually pressed into the housing 50 in the direction of arrow 61. A round 60 formed on the outer side of the indentation 55 eases the insertion and full retraction of the foot pedal 54 into the housing 50. To retain the foot pedal within the recessed housing 50 a key 65 protrudes from proximal end 66 of the pedal 54. As illustrated in FIG. 4, when the foot pedal 54 is pressed back fully into the housing 50 in the direction of the arrow 61, the key 65 is seated in a slot 67 that is formed in the wall of the housing 50. When so received, the surface 56 of the pedal 54 bears against the top of the stop 53 and the key 65, at the proximal end 66 of the pedal 54, is supported in its companion slot 67 to retain the retracted foot pedal 54 within the recessed housing 50.

When it is desired to extend the foot pedal 54 from the housing 50 in the direction of arrow 57, distal end 70 of the foot pedal 54 protrudes beyond the stop 53. So extended, foot pressure on exposed portion 63 of the pedal 54 presses the bearing surfaces 56 against the stop 53 and supporting surface 64 to stabilize the foot pedal 54 against both the stop 53 and the supporting surface 64.

A corresponding foot pedal (not shown in the drawing) in accordance with a feature of the invention, provided at the opposite side of the waste receptacle 10 enables the user to steady the receptacle 10 on the supporting surface 64 by placing each foot on a respective pedal and pressing the pedals against the supporting surface 64. Thus stabilized, the user can withdraw a flexible trash bag (not shown) from the waste receptacle 10 with both hands without touching the trash contents, tipping the waste receptacle or spilling the trash.

Consequently, there is provided in accordance with the invention an improved waste receptacle that overcomes the awkward and unsanitary mishaps that have characterized the use of prior art receptacles.

What is claimed is:

1. A waste receptacle having a base and at least two lateral sides integral with the base and extending therefrom comprising at least two foot pedals for selective extension from and retraction into the base and the respective sides, the base and the sides each forming an associated individual recessed housing to accommodate a respective one of said foot pedals within said associated individual recessed housing, detents for releasably retaining said foot pedals in said selective extension from and retraction into said associated recesses, a bearing surface on each of said foot pedals, each of said bearing surfaces having at least one indentation formed therein, and corresponding stops protruding from said respective recessed housings to engage selectively said bearing surface indentations and to releasably retain said foot pedals in said selective extension from the waste receptacle, said protruding stops having means for bridging across said recessed housing.

2. A waste receptacle according to claim 1 further comprising a round formed in said respective foot pedal indentations, said rounds each facilitating said selective retractions of said foot pedals into said recessed housings.

* * * * *